US010984808B2

(12) United States Patent
Husain

(10) Patent No.: US 10,984,808 B2
(45) Date of Patent: Apr. 20, 2021

(54) METHOD FOR MULTI-STAGE COMPRESSION IN SUB-BAND PROCESSING

(71) Applicant: 2236008 Ontario Inc., Waterloo (CA)

(72) Inventor: Mohammad Aamir Husain, Surrey (CA)

(73) Assignee: BlackBerry Limited, Waterloo (CA)

( * ) Notice: Subject to any disclaimer, the term of this patent is extended or adjusted under 35 U.S.C. 154(b) by 61 days.

(21) Appl. No.: 16/506,545

(22) Filed: Jul. 9, 2019

(65) Prior Publication Data

US 2021/0012785 A1 Jan. 14, 2021

(51) Int. Cl.

| | |
|---|---|
| ***G10L 19/02*** | (2013.01) |
| ***G10L 25/18*** | (2013.01) |
| ***G10L 25/15*** | (2013.01) |

(52) U.S. Cl.

CPC ..... *G10L 19/0204* (2013.01); *G10L 25/15* (2013.01); *G10L 25/18* (2013.01)

(58) Field of Classification Search

CPC . G10L 19/02; G10L 19/0204; G10L 19/0208; G10L 25/03; G10L 25/15; G10L 25/18

See application file for complete search history.

(56) References Cited

U.S. PATENT DOCUMENTS 5,890,125 A * 3/1999 Davis ..... G10L 19/008 704/501
5,999,899 A * 12/1999 Robinson ..... H04B 1/665 704/219
6,501,860 B1 * 12/2002 Charrier ..... G06T 9/008 375/240.02
7,239,253 B1 * 7/2007 Denninghoff ..... G10L 19/0208 341/200
8,457,976 B2 * 6/2013 Paranjpe ..... H03K 5/00 704/500
8,788,277 B2 * 7/2014 Vezyrtzis ..... G10L 19/0208 704/500
9,076,425 B2 * 7/2015 Yoo ..... G10L 21/0364
9,255,318 B2 * 2/2016 Ono ..... C23C 2/02
10,075,802 B1 * 9/2018 Kim ..... G10L 25/21

(Continued)

FOREIGN PATENT DOCUMENTS

EP 2755205 7/2014

OTHER PUBLICATIONS

Extended European Search Report, EP Application No. 20177030.2 dated Nov. 12, 2020.

*Primary Examiner* — Eric Yen
(74) *Attorney, Agent, or Firm* — Rowand LLP

(57) ABSTRACT

A sub-band processing system for reducing computational complexity and memory requirements is disclosed. The sub-band processing system includes: a first logic that partitions and stores a frequency spectrum of bins of real and imaginary data into a smaller number of sub-bands; a second logic that executes a first lossy compression for a first set of the sub-bands, wherein the first set includes those sub-bands having indices that are greater than or equal to a first index; and a third logic that executes, subsequent to a frequency spectrum processing of the lossy compressed data rendered by the second logic, a second lossy compression for a second set of the sub-bands, wherein the second set includes those sub-bands having indices that are less than the first index and greater than or equal to a second index.

21 Claims, 3 Drawing Sheets

(56) References Cited

U.S. PATENT DOCUMENTS

| | | | | |
|---|---|---|---|---|
| 2002/0006229 | A1* | 1/2002 | Chao | H04N 19/63 382/240 |
| 2005/0015249 | A1* | 1/2005 | Mehrotra | G10L 19/038 704/230 |
| 2005/0283370 | A1* | 12/2005 | Mpr | G10L 19/16 704/501 |
| 2006/0122825 | A1* | 6/2006 | Oh | G10L 19/022 704/203 |
| 2006/0140406 | A1* | 6/2006 | Van DerVeen | G11B 20/00891 380/202 |
| 2006/0248135 | A1* | 11/2006 | Cousineau | H04L 27/265 708/404 |
| 2006/0271357 | A1* | 11/2006 | Wang | G10L 19/005 704/223 |
| 2009/0313009 | A1* | 12/2009 | Kovesi | G10L 19/24 704/203 |
| 2010/0198603 | A1* | 8/2010 | Paranjpe | G10L 19/0204 704/500 |
| 2013/0257482 | A1* | 10/2013 | Paranjpe | G10L 19/0204 327/3 |
| 2015/0046171 | A1* | 2/2015 | Grancharov | G10L 19/028 704/500 |
| 2017/0092282 | A1* | 3/2017 | Choo | G10L 19/012 |
| 2017/0142412 | A1* | 5/2017 | Fuchs | H04N 19/91 |
| 2018/0247662 | A1* | 8/2018 | Fan | G10L 21/0232 |
| 2020/0013215 | A1* | 1/2020 | Vosoughi | G06K 9/6211 |
| 2020/0294519 | A1* | 9/2020 | Mariglio, III | G10L 19/083 |

* cited by examiner

METHOD FOR MULTI-STAGE COMPRESSION IN SUB-BAND PROCESSING

TECHNICAL FIELD

The present disclosure relates to sub-band processing and, in particular, to systems that reduce computational complexity and memory requirements.

BACKGROUND

Frequency domain based adaptive filtering is computationally intensive as it translates a time domain signal into multiple frequency components that are processed individually. Wider bandwidth networks provide higher throughput and better performance than narrowband networks but at the expense of an increase in processing loads and memory requirements—as the bandwidth increases, so too does the number of frequency components used to represent the signal. This increase in the number of components at higher sampling rates results in a proportional increase in processing loads and memory required.

To reduce processing load and memory requirements for ease of implementation, a frequency domain-based system compresses data through a lossy compression scheme and performs subsequent processing of the lossy signal before reconstructing back the data into the time domain with an inverse process to the one used to translate the time domain signal into multiple frequency components. It is desirable to perform the lossy compression in a way that ensures minimal perceptual distortion is introduced in the resulting reconstructed data.

BRIEF DESCRIPTION OF DRAWINGS

Reference will now be made, by way of example, to the accompanying drawings which show example embodiments of the present application and in which.

Like reference numerals are used in the drawings to denote like elements and features.

DETAILED DESCRIPTION OF EXAMPLE EMBODIMENTS

Figure 1:
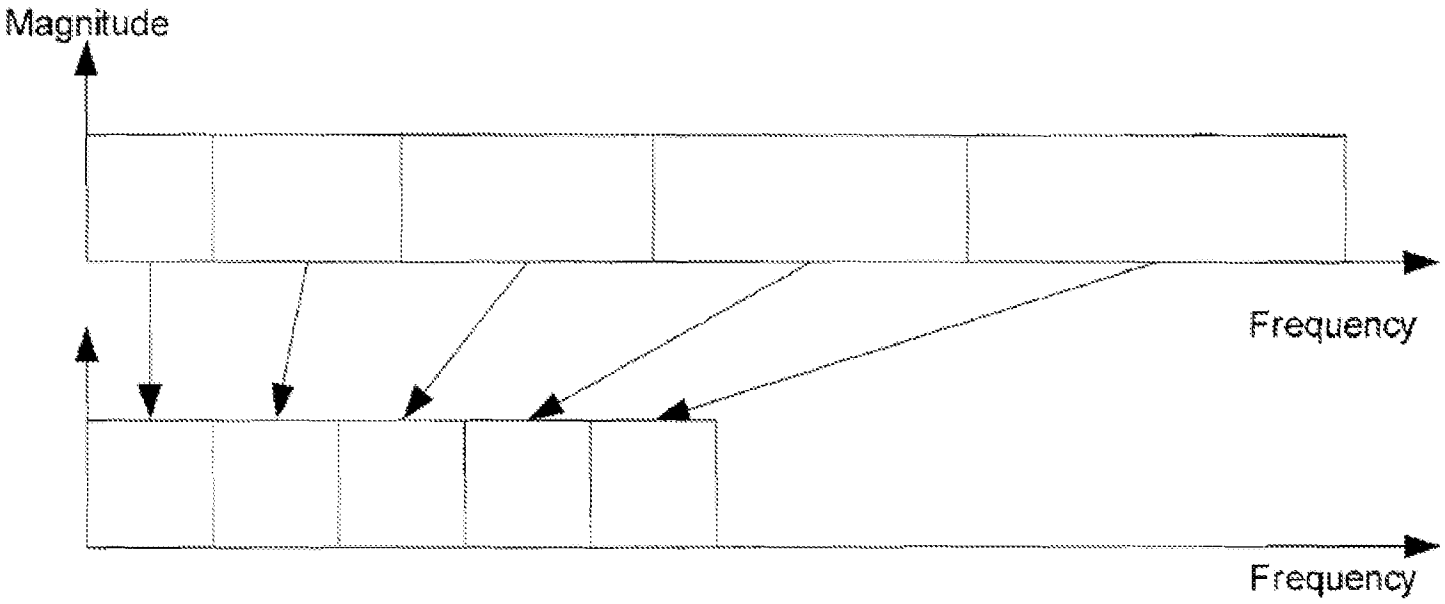
FIG. 1 is a non-overlapping frequency compression of an uncompressed frame.
Figure 2:
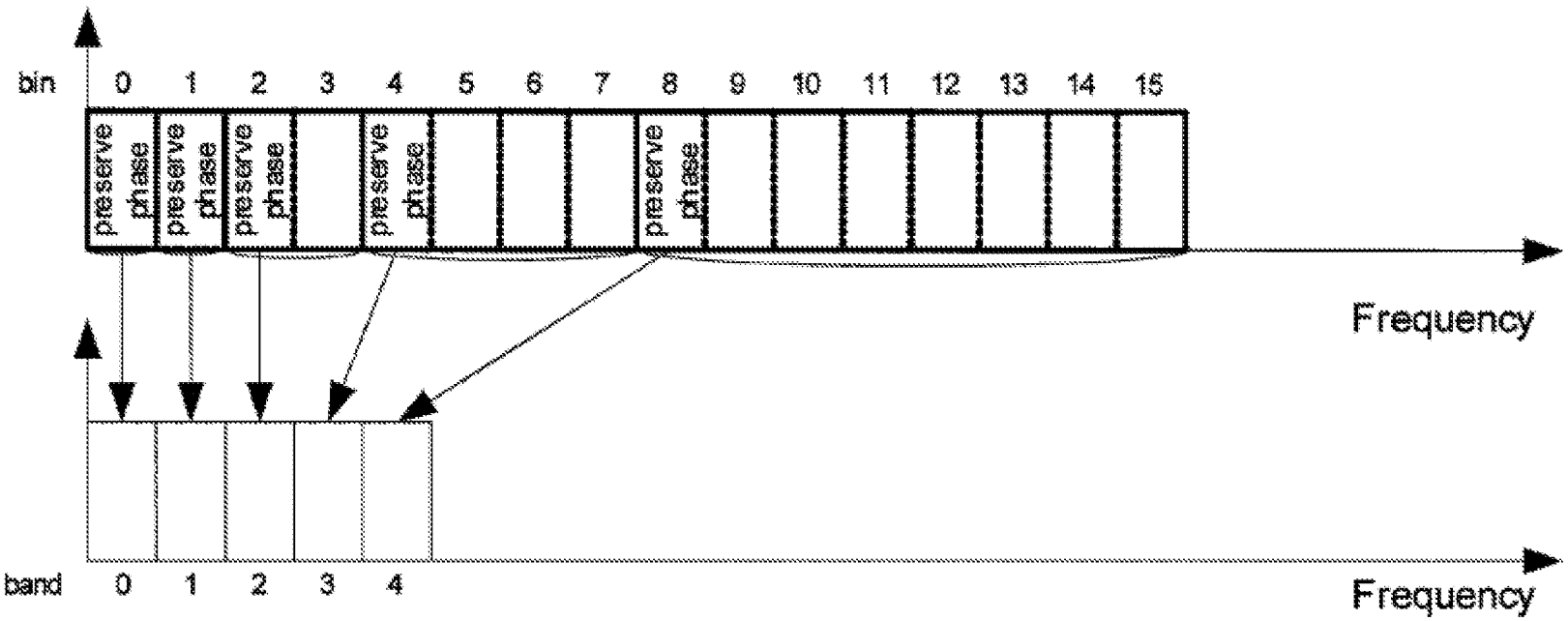
FIG. 2 is a non-overlapping compression showing a phase selection.
Figure 3:
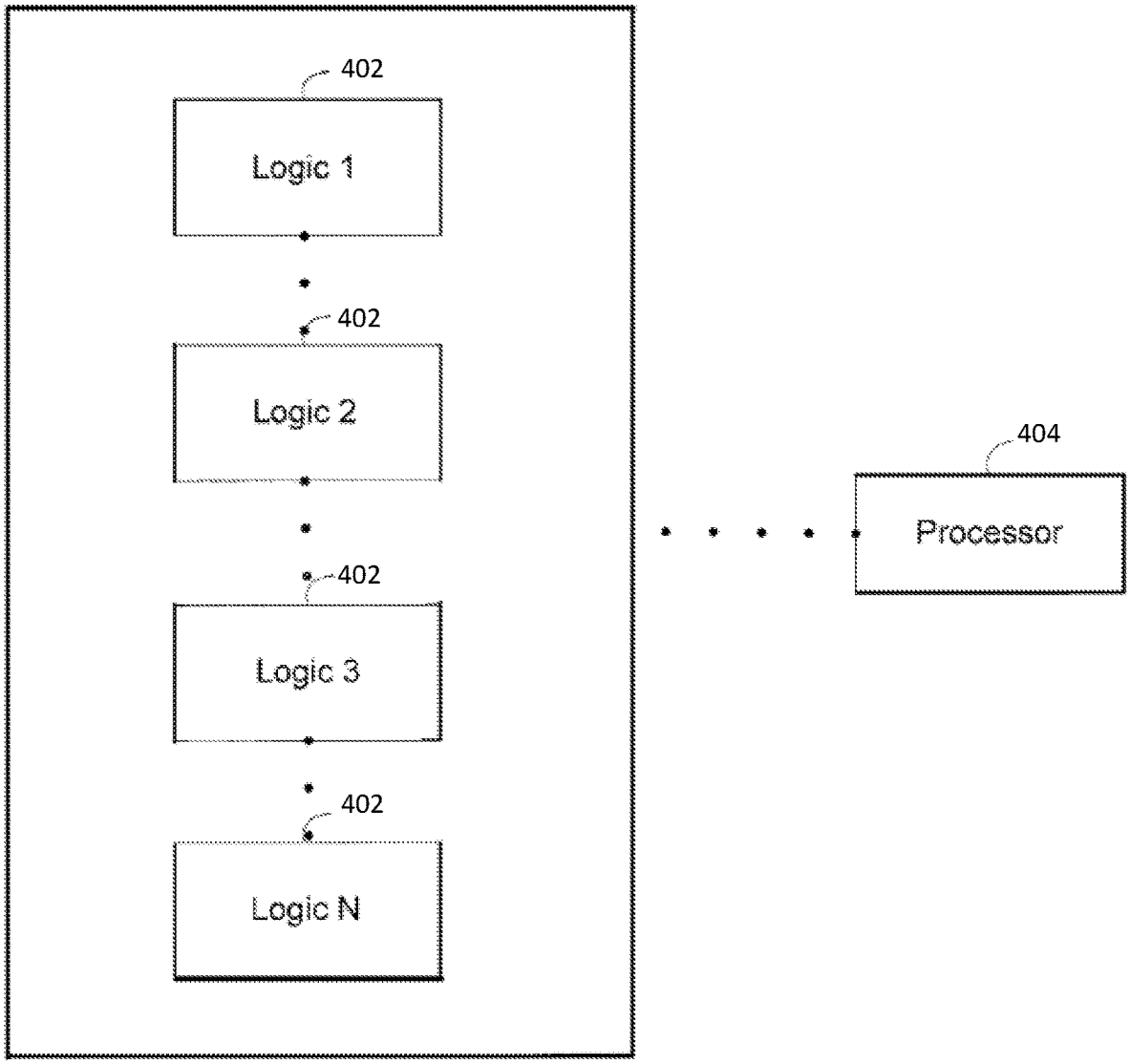
FIG. 3 shows a block diagram of an exemplary sub-band processing system.

In one aspect, the present disclosure describes a system comprising: a first logic stored in a computer-readable medium and executable by a processor that partitions and stores a frequency spectrum of bins of real and imaginary data into a smaller number of sub-bands; a second logic stored in the computer-readable medium and executable by the processor that executes a first lossy compression for a first set of the sub-bands, the first lossy compression compressing a designated magnitude of one bin in each sub-band of the first set that is representative of that sub-band and a designated phase of one bin in each sub-band of the first set that is representative of that sub-band, wherein the first set includes those sub-bands having indices that are greater than or equal to a first index; and a third logic stored in the computer-readable medium and executable by the processor that executes, subsequent to a frequency spectrum processing of the lossy compressed data rendered by the second logic, a second lossy compression for a second set of the sub-bands, the second lossy compression compressing a designated magnitude of one bin in each sub-band of the second set that is representative of that sub-band and a designated phase of one bin in each sub-band of the second set that is representative of that sub-band, wherein the second set includes those sub-bands having indices that are less than the first index and greater than or equal to a second index.

In another aspect, the present disclosure describes an echo cancellation system for processing a plurality of frames of data. The echo cancellation system includes: a processor that executes a computer readable medium comprising: computer program code that determines a first number of sub-bands for a module of the echo cancellation system to process for a first set of the plurality of frames and a second number of sub-bands for the module to process for a second set of the plurality of frames, such that a sub-band count alternates between the first number and the second number during processing of each pair of sequential frames.

Other example embodiments of the present disclosure will be apparent to those of ordinary skill in the art from a review of the following detailed descriptions in conjunction with the drawings.

A sub-band processing system processes data such that, after it is compressed and decompressed, it is restored to its original format. The sub-band processing system may compress video, audio, text, code, and/or numeric data such that little or no data is lost after a bin or file is decompressed. Some systems preserve the original data (or a representative data set) while compressing and decompressing operating data through a lossy compression. After further processing by an ancillary device or system, the sub-band processing system reconstructs and restores the data.

The sub-band processing system analysis may occur on frequency domain characteristics. To derive frequency domain properties, the signal may be broken into intervals though a multiplier function (retained in a local or a distributed computer readable medium) or multiplier device that multiplies the signal by a "window" function or a "frame" of fixed duration. To minimize spectral distortion, smooth window functions (such as Hann, Hamming, etc. retained in the local or the distributed computer readable medium) or a window filter may be used for the short-time spectral analysis. A time-to-frequency transform device, a Discrete Fourier Transform (DFT) device, or a Fast Fourier Transform (FFT) device may transform (or decompose) the short-time based signals into a complex spectrum. The spectrum may be separated into bins of magnitude and phase data or substantially equivalent complex (e.g. real and imaginary) data. A sub-band (or band) may be represented by a single bin of magnitude and phase spectra, or a collection of consecutive or successive bins represented by a common or single magnitude and phase spectra. Table 1 shows representative characteristics of an exemplary FFT device:

TABLE 1

| Sample rate | 8 | 16 | 24 | 32 | 48 |
|---|---|---|---|---|---|
| FFT length (N) | 256 | 512 | 768 | 1024 | 1536 |
| Number of useful output bins | 129 | 257 | 385 | 513 | 769 |
| Hz/bin | 31.25 | 31.25 | 31.25 | 31.25 | 31.25 |

At a sample rate of about 8 kHz, an FFT device may transform the time domain signal into about 256 bins. Due to the complex symmetry, the FFT device may yield about 129 useful bins (e.g., 256/2+1). Each bin may represent a frequency resolution of about 31.25 Hz (e.g., 8 kHz/256). The frequency resolution of other sample rates (e.g., 16 kHz and 32 kHz) may be maintained by changing the FFT length. For example, at 16 kHz, the FFT length may be about double the FFT length of the 8 kHz sample rate. At 32 kHz, the FFT length may be about double the FFT length of the 16 kHz sample rate.

In some systems, the magnitude and phase spectra may be obtained from one or more signal processors that execute a Discrete Fourier Transform (DFT) stored in a local or a distributed memory. The output of the DFT may be represented by X(k):

$$X(k) = \sum_{n=0}^{N-1} x(n)e^{-j\frac{2\pi nk}{N}} \tag{1}$$

for k=0 . . . N−1, where K is the frequency index for each bin, N is the time index for each sample, and N is the length of the DFT (or FFT).

The bins (R) of the FFT (or DFT) device may be partitioned into a fewer (or smaller R≥M) number of sub-bands (M). In some applications, the sub-band processing system may reduce M to a lowest possible integer that does not affect the performance or quality of a later process. In these applications, the system may generate a selected number of sub-bands that minimize perceptual error. The applications may exploit the sensitivity of the human auditory system or other systems that do not detect or process certain frequencies or are affected by certain signal distortions.

A lossy compression may compress the data such that some data is lost when the data is compressed into the sub-bands. Some sub-band processing systems compress q bins (q is an integer greater than 1) into individual sub-bands. Other systems apply a perceptual scale (through a processor or controller, for example) where the bins are grouped into sub-bands that match the frequency selectivity of the human auditory system such that the compression divides a variable sequence of uncompressed bins into a substantially equal sequence of compressed sub-bands. Perceptual distortions may be minimized by applying lower compression ratios at lower frequencies while applying higher compression ratios at higher frequencies. Table 2 describes an exemplary compression scheme in which each sub-band represents q bins for a 16 kHz sampling rate system:

TABLE 2

| Approximate frequency range (kHz) | Input bin numbers | Compression ratio | Output sub-bands #s |
|---|---|---|---|
| 0-3 | 0 . . . 95 | 1:1 | 0 . . . 95 |
| 3-4.6 | 96 . . . 147 | 2:1 | 96 . . . 121 |
| 4.6-6.2 | 148-198 | 3:1 | 122 . . . 138 |
| 6.2-7.8 | 199 . . . 250 | 4:1 | 139 . . . 151 |
| 7.8-Nyquist | 251 . . . R-1 | 5:1 | 152, 153 |

The selected or designated magnitudes in each sub-band may be obtained by various schemes. When a maximum magnitude system is used, and a maximum magnitude is detected, the bin containing that magnitude is indexed, and stored in memory. Other systems may select the magnitude of the first bin within the sub-band that has the lowest frequency within that sub-band. Other systems may select a combination of both methods with lower compressed sub-bands making use of maximum magnitude as a selection criterion and higher compressed sub-bands making use of first bin within the sub-band.

While various lossy compression schemes may be used, the sub-band processing system may select or designate a representative phase for each sub-band. Some sub-band processing systems select the phase of a bin within the sub-band that has the lowest frequency within that sub-band. Other systems may select bins based on the index of the maximum magnitude found, and others may select some other qualitative measure.

Depending on the phase index selected, the maximum magnitude may be rotated or shifted (i.e. adjusted) to attain the selected or designated phase as the phase of index with maximum magnitude selected from its constituent bins, and the phase of the "preserved" or selected bin may be different.

In the sub-band processing system, the magnitude, |SBX(m)|, and phase, arg(SBX(m)), for each sub-band may be:

$$SBX(m)=|SBX(m)|,\arg(SBX(m)) \tag{2}$$

$$\text{where } |SBX(m)|=\max(|X(j_m)|,|X(j_m+1)|, \ldots ,|X(j_m+D_m-1)|) \tag{3}$$

$$\arg(SBX(M))=\arg(X(j_m)) \text{ or } \arg(X(h_m)) \tag{4}$$

$$h_m=\arg\max(|X(j_m)|,|X(j_m+1)|, \ldots ,|X(j_m+D_m-1)|) \quad \text{for } m=0, \ldots M-1 \tag{5}$$

where m is the index for each sub-band;

$j_m$ is the starting (uncompressed frequency bin) index for sub-band in and may also be the index of the bin whose phase is preserved for sub-band m;

$D_m$ is the number of uncompressed bins that are "compressed" into sub-band m;

$h_m$ is the uncompressed frequency index of the bin that has the maximum magnitude for sub-band in and may also be the index of the bin whose phase is preserved for sub-band m.

In some systems, common bins may be selected from the divided spectrum to attempt to preserve the phase of the sub-bands relative to each processed frame. In these systems $j_m$ and $D_m$ may be constant (e.g. temporally invariant) while $h_m$ may change (e.g. time variant) from one aural or sound frame (or video, sound, text, code, and/or numeric data) to the next. Such systems may try to preserve the phase of the same bin within a sub-band on a frame-by-frame basis such as, for example, always the first bin of a sub-band in each frame or a common bin of a sub-band in each frame. Other systems may not try to preserve the phase from frame to frame, like when $h_m$ is the index of the selected phase that is preserved.

By maintaining magnitude and phase spectra through the adjusted sub-band spectrum, or "sparse spectrum", the spectrum may be further processed in the frequency domain (or other domains). Adaptive filtering techniques or devices used by an acoustic echo canceller, noise cancellation, or a beam-former, for example, are sensitive to changes in phase and may need to process a consistent phase that does not change abruptly from frame to frame. In addition, an accurate approximation of the magnitude spectrum of the bins with the compressed sub-band representation is also critical. Abrupt phase changes may be identified as an impulse response that causes an acoustic echo canceller to diverge. When divergence occurs, a sub-optimal, reduced, or no echo cancellation may occur due to the mismatch between the filter coefficients and the echo path characteristics. When a divergence is declared, an adaptive filter may require time to achieve a convergence.

Making use of such systems may still result in the phase data not being consistently preserved from frame to frame for the compressed bins. In particular, any added perceptual distortion introduced by the compression may not be sufficiently minimized and, for example, the acoustic echo canceller may diverge. To ensure that subsequent processing (such as acoustic echo cancellation) is not impacted adversely by these compression techniques within a sub-band, some systems may have the magnitude, |SBX(m)|, and phase, arg(SBX(m)), compressed in two separate stages. In the first stage, only those sub-bands with indices m greater than or equal to $M_{unc}$ that are not susceptible to abrupt phase changes and inadequate magnitude representation in each frame are compressed. The sub-bands with indices less than $M_{unc}$ but greater than or equal to $M_{unc2}$ are compressed afterward, following processing by a subsequent block such as the acoustic echo canceller. This can be done by selecting:

$$SBX(m)=|SBX(m)|,\arg(SBX(m)) \tag{6}$$

$$|SBX(m)|=|X(j_m)| \text{ and} \tag{7}$$

$$\arg(SBX(m))=\arg(X(j_m)) \tag{8}$$

for $m=M_{unc}, \ldots, M_1-1$, where

- m is the index for each sub-band;
- $j_m$ is the starting (uncompressed frequency bin) index for sub-band in and may also be the index of the bin whose phase and magnitude is preserved for sub-band m;
- $D_m$ is the number of uncompressed bins that are "compressed" into sub-band m;
- $M_{unc}$ is the index of the sub-band below which compression is not performed in the first stage;
- $R_{unc}$ is the index of the corresponding bins below which compression is not performed in the first stage;
- $M_{unc2}$ is the index of the bands below which compression is not performed after the second stage and where $R_{unc} \leq R$ and $M_{unc} \leq M$ and $M_{unc} \leq R_{unc}$ and $M_{unc2} \leq M_{unc}$;
- $M_1$ is the number of sub-bands after the first stage of compression.

$M_{unc2}$ has been previously obtained from Equations 2-5 above as the sub-band at which, if full compression had been performed, the bins in a sub-band are represented by a single bin and where $D_m>1$. In addition, though bands are not compressed between $M_{unc2}$ and $M_{unc}$ in the first stage, their indices, as given by $h_m$ in Equation 5, are stored for subsequent use in the second stage of compression during the subsequent processing block.

This subsequent processing block requires as its input, processing bins that are not compressed below a threshold $R_{unc}$ to ensure adequate minimization of perceptual distortion being introduced by the compression process. After the subsequent processing step, such as acoustic echo cancellation for example, sub-bands less than $M_{unc2}$ are not compressed and sub-bands greater than or equal to $M_{unc2}$ are compressed in two stages, with bands greater than or equal to $M_{unc}$ being compressed in the initial stage and the remaining sub-bands being compressed in the subsequent processing step. Table 3 describes an exemplary two-stage compression scheme in which each sub-band represents q bins for a 16 kHz sampling rate system:

TABLE 3

| Approximate frequency range (kHz) | Input bin numbers | Compression ratio | First stage output sub-bands #s | Second stage output sub-bands #s |
|---|---|---|---|---|
| 0-3 | 0 . . . 95 | 1:1 | 0 . . . 95 | 0 . . . 95 |
| 3-4.6 | 96 . . . 147 | 2:1 | 96 . . . 147 | 96 . . . 121 |
| 4.6-6.2 | 148-198 | 3:1 | 144 . . . 198 | 122 . . . 138 |
| 6.2-7.8 | 199 . . . 250 | 4:1 | 199 . . . 250 | 139 . . . 151 |
| 7.8-Nyquist | 251 . . . 256 | 5:1 | 251, 252 | 152, 153 |

In Table 3 above, $M_{unc2}$ is 96, $M_{unc}$ is 152, $R_{unc}$ is 251, M is 154, $M_1$ is 253, and R is 257. The first stage compression will take R=257 bins and compress them down to $M_1$=253 sub-bands, and then the subsequent processing module will take the $M_1$=253 sub-bands and further compress them down to M=154 sub-bands. These compressed sub-bands can then be used in further subsequent processing after the acoustic echo cancellation stage, for example.

An acoustic echo cancellation processing system consists of various sub-systems that are processed for every input frequency band on a frame by frame basis. Some of the parameters computed in these sub-modules may vary significantly from frame to frame while others may vary seldomly. Some of the parameters may be sub-sampled, so that instead of having the parameters updated every frame, they may be updated every $n^{th}$ frame instead, slowing down the speed of adaptation, which in turn may negatively affect the performance of the echo canceller. Higher frequency sub-bands are much less negatively impacted by this sub-sampling and so some benefit could be obtained by sub-sampling unequally the different sub-bands in the system without any appreciable degradation in perceptual distortion in the reconstructed output speech.

In some systems, the number of sub-bands used in the various sub-modules within the acoustic echo cancellation module are alternated from frame to frame, with every odd processing frame making use of $M_1$ number of sub-bands, and so some savings in complexity reduction could be obtained depending on how much smaller $M_1$ is when compared to R. On the even processing frames, the number of bins used would be set to $M_{unc2}$ which may be much smaller than $M_1$. This may lead to processing load savings in the sub-module in question as the number of sub-bands would have dropped from $M_1$ to $M_{unc2}$. In an exemplary system, with a 16 kHz sampling rate as an example, the sub-band count could alternate between 253 and 96, thereby yielding similar savings in processing loads to one in which all compression was achieved in a single-stage. The impact of slowing down the adaptation of various sub-modules for the compressed sub-bands on the perceptual quality may be minimal. Some sub-modules may need to have their adaptation parameters changed to adapt faster for those sub-bands which were sub-sampled. This way, the net change in long-term adaptation is minimal across those sub-bands when compared to sub-bands that are not sub-sampled.

In some other systems, the compressed band index information $h_m$ that was computed by Equation 5 in the first stage could be used to decide which of the bins in a compressed sub-band to update in a frame. Only those bins represented by index $h_m$ are adapted. This implies that within each of the sub-modules, not all bins are processed, skipping over $h_m-1$ bins in each sub-band. In addition, as not all bins are updated every frame, the non-updating bins may need to be adapted in some form to prevent the adaptation from resulting in poorer performance due to a mismatch in the parameter adaptation between the bins that are adapted and the other $h_m-1$ bins that are not adapted in each sub-band. In some systems, this can be done by taking on the updated values of the non-adapted bins to be the same as the neighboring adapted bins.

In either of these systems, the output signal of the acoustic echo canceller module could be sub-sampled by taking from the $M_1$ output samples, the sub-bands at only the indices specified by index $h_m$ from Equation 5, thereby achieving the second stage of compression.

This two-stage approach may provide equivalent memory savings and processing load reductions for any further processing downstream of the acoustic echo cancellation. In addition, equivalent processing load reductions may be achieved in the acoustic echo cancellation module in this exemplary scheme as well as memory savings within the acoustic echo cancellation module. This approach may also provide the added advantage of offering significant reduction in perceptual distortion in the reconstructed output signal.

When reconstructing the processed spectrum, the original spectral data (or a representative data set, or a data set of relative measures) is processed so that little or no data is lost when the decompression is complete. By processing the original spectral data (or the representative data or relative measure data set), the sub-band processing system may achieve a lossless or nearly lossless compression. Some systems may preserve almost the entire original spectrum to avoid generating perceivable artifacts when the spectrum is reconstructed.

An overlap-add synthesis may partially reconstruct the spectrum from the processed sparse spectrum. An overlap-add synthesis may avoid discontinuities in the reconstructed spectrum. For each sub-band, the system rotates the remaining bins that made up the sub-band by maintaining relative magnitudes and phases of the original spectrum (or representative data or relative measure data set). The magnitude and phase of the remaining reconstructed bins maintain the same relative magnitude and phase relationship with the restored peak magnitude bin, as the original spectral bins had with the original peak magnitude bin.

Because further processing (e.g., echo cancellation, noise reduction, beam former, signal attenuators, amplifiers, signal modifier, etc.) may alter the magnitude and phase of each sub-band, quantitatively each SBX(m) has been transformed into SBY(m). Equations 9-13 describe how the magnitude and phase for each sub-band may be expanded to its constituent bins. Equation (10) establishes that the magnitude of the restored selected bin is equal to the magnitude of the processed sub-band m. Equation (11) establishes that the phase of the restored selected is equal to the phase of the processed sub-band m after processing. Equations (12) and (13), respectively, establish how the remaining bins may be reconstructed.

$$SBY(m) = |SBY(m)|, \arg(SBY(m)) \tag{9}$$

$$|Y(h_m)| = |SBY(m)| \tag{10}$$

$$\arg(Y(h_m)) = \arg(SBY(m)) \tag{11}$$

$$|Y(p)| = |Y(h_m)| \times \frac{|X(p)|}{|X(h_m)|} \tag{12}$$

$$\arg(Y(p)) = \arg(Y(h_m)) - \arg(X(h_m)) + \arg(X(p)) \tag{13}$$

for m=0, . . . , M−1 where m is the index for each sub-band $j_m$ is the starting (uncompressed frequency bin) index for sub-band m $D_m$ is the number of uncompressed bins that are "compressed" into sub-band m $h_m$ is the uncompressed frequency index of the bin that was selected in the first-stage compression stage for sub-band m p are the indexes in the range $[j_m, j_m+D_m-1]$ that do not equal $h_m$ Once the complex spectrum is restored, a time domain signal may be generated by an Inverse Fourier Transform device (or function stored in a local or a distributed memory). If windows were used during system analysis, an overlap-add function may be used for synthesis.

Until the spectrum is restored, the original spectrum (or the representative data set) may be retained in a computer readable medium or memory so that the original relative magnitude and phase relationships may be maintained or restored in the decompressed spectrum. This retention potentially reduces audible artifacts that may be introduced by a compression scheme.

The system methods, and descriptions described may be programmed in one or more controllers, devices, processors (e.g., signal processors). The processors may comprise one or more central processing units that supervise the sequence of micro-operations that execute the instruction code and data corning from memory (e.g., computer readable medium) that generate, support, and/or complete an operation, compression, or signal modification. The dedicated applications may support and define the functions of the special purpose processor or general-purpose processor that is customized by instruction code (and in some applications may be resident to vehicles). In some systems, a front-end processor may perform the complementary tasks of gathering data for a processor or program to work with, and for making the data and results available to other processors, controllers, or devices.

The systems, methods, and descriptions may program one or more signal processors or may be encoded in a signal bearing storage medium, a computer-readable medium, or may comprise logic 402 stored in a memory that may be accessible through an interface and is executable by one or more processors 404 as shown in FIG. 4 (in FIG. 4, comprises an integer). Some signal-bearing storage medium or computer-readable medium comprise a memory that is unitary or separate (e.g., local or remote) from a device, programmed within a device, such as one or more integrated circuits, or retained in memory and/or processed by a controller or a computer. If the descriptions or methods are performed by software, the software or logic may reside in a memory resident to or interfaced to one or more processors, devices, or controllers that may support a tangible or visual communication interface (e.g., to a display), wireless communication interface, or a wireless system.

The memory may retain an ordered listing of executable instructions in a processor, device, or controller accessible medium for implementing logical functions. A logical function may be implemented through digital circuitry, through source code, or through analog circuitry. The software may be embodied in any computer-readable medium or signal-bearing medium, for use by, or in connection with, an instruction executable system, apparatus, and device, resident to system that may maintain persistent or non-persistent connections. Such a system may include a computer system, a processor-based system, or another system that includes an input and output interface that may communicate with a publicly accessible or privately accessible distributed network through a wireless or tangible communication bus through a public and/or proprietary protocol.

A "computer-readable storage medium" "machine-readable medium," "propagated-signal" medium, and/or "signal-bearing medium" may comprise a medium that stores, communicates, propagates, or transports software or data for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical connection having one or more wires, a portable magnetic or optical disk, a volatile memory, such as a Random-Access Memory (RAM), a Read-Only Memory (ROM), an Erasable Programmable Read-Only Memory (EPROM or Flash memory), or an optical fiber. A machine-readable medium may also include a tangible medium, as the software may be electronically stored as an image or in another format (e.g., through an optical scan), then compiled, and/or interpreted or otherwise processed. The processed medium may then be stored in a computer and/or machine memory.

The various embodiments presented above are merely examples and are in no way meant to limit the scope of this application. Variations of the innovations described herein will be apparent to persons of ordinary skill in the art, such variations being within the intended scope of the present application. In particular, features from one or more of the above-described example embodiments may be selected to create alternative example embodiments including a sub-combination of features which may not be explicitly described above. In addition, features from one or more of the above-described example embodiments may be selected and combined to create alternative example embodiments including a combination of features which may not be explicitly described above. Features suitable for such combinations and sub-combinations would be readily apparent to persons skilled in the art upon review of the present application as a whole. The subject matter described herein and in the recited claims intends to cover and embrace all suitable changes in technology.

The invention claimed is:

1. A compression system comprising:

a processor; and a non-transitory, computer readable medium storing instructions executable by the processor, the instructions comprising:

first computer program code that partitions and stores a frequency spectrum of bins of real and imaginary data into a smaller number of sub-bands;

second computer program code that executes a first lossy compression for a first set of the sub-bands, the first lossy compression compressing a designated magnitude of at least one bin in each sub-band of the first set that is representative of that sub-band and a designated phase of at least one bin in each sub-band of the first set that is representative of that sub-band, wherein the first set includes those sub-bands having indices that are greater than or equal to a first index; and third computer program code that executes, subsequent to a frequency spectrum processing of the lossy compressed data rendered by the second computer program code, a second lossy compression for a second set of the sub-bands, the second lossy compression compressing a designated magnitude of at least one bin in each sub-band of the second set that is representative of that sub-band and a designated phase of at least one bin in each sub-band of the second set that is representative of that sub-band, wherein the second set includes those sub-bands having indices that are less than the first index and greater than or equal to a second index.

2. The compression system of claim 1, wherein the first index is determined based on a total number of bins in the frequency spectrum and a compression ratio of the first lossy compression.

3. The compression system of claim 1, further comprising a fourth computer program code that renders a lossless compression by decompressing lossy compressed data rendered by the third computer program code and providing magnitude data and phase data not maintained by the first and second lossy compressions based on original spectral relationships contained within the frequency spectrum.

4. The compression system of claim 3, wherein the frequency spectrum processing is performed by an acoustic echo canceller after the first lossy compression and before the fourth computer program code provides the magnitude and phase data.

5. The compression system of claim 3, wherein the frequency spectrum processing is performed by a noise canceller after the first lossy compression and before the fourth computer program code provides the magnitude and phase data.

6. The compression system of claim 3, wherein the frequency spectrum processing is performed by a beam former after the first lossy compression and before the fourth computer program code provides the magnitude and phase data.

7. The compression system of claim 3, wherein the fourth computer program code comprises:

computer program code that rotates each designated magnitude in each sub-band of the first and second sets to an original phase position; and computer program code that restores the bins that comprise the sub-bands rendered by the first computer program code by reconstructing and substantially maintaining relative magnitudes and relative phases of the frequency spectrum partitioned by the first computer program code.

8. The compression system of claim 1, wherein the real and imaginary data comprise magnitude and phase spectra.

9. The compression system of claim 1, wherein the second computer program code processes a plurality of frames of data and designates a first bin in each sub-band as representative phase and magnitude for each frame of data the compression system processes.

10. The compression system of claim 1, wherein the third computer program code processes a plurality of frames of data and designates a common bin in each sub-band as representative phase and magnitude for each frame of data the compression system processes.

11. The compression system of claim 10, wherein respective designated magnitudes comprise a designated peak magnitude.

12. The compression system of claim 1, where each of the sub-bands of the first and second sets comprises a single bin and a plurality of successive bins of real and imaginary data.

13. The compression system of claim 1, further comprising a multiplier device that multiplies the frequency spectrum by a window function before the frequency spectrum is partitioned.

14. The compression system of claim 1, further comprising a time-to-frequency transform device that decomposes a time-based signal into the frequency spectrum before the frequency spectrum is partitioned.

15. The compression system of claim 1, further comprising a Discrete Fourier Transform device that decomposes a time-based signal into the frequency spectrum before the frequency spectrum is partitioned.

16. The compression system of claim 1, further comprising a Fast Fourier Transform device that decomposes a time-based signal into the frequency spectrum before the frequency spectrum is partitioned.

17. The compression system of claim 1, wherein the first computer program code partitions the frequency spectrum of bins of real and imaginary data into sub-bands that match a frequency sensitivity of a human auditory system.

18. A non-transitory, computer readable medium storing instructions which, when executed by a processor, configure the processor to:

partition and store a frequency spectrum of bins of real and imaginary data into a smaller number of sub-bands;

execute a first lossy compression for a first set of the sub-bands, the first lossy compression compressing a designated magnitude of at least one bin in each sub-band of the first set that is representative of that sub-band and a designated phase of at least one bin in each sub-band of the first set that is representative of that sub-band, wherein the first set includes those sub-bands having indices that are greater than or equal to a first index; and execute, subsequent to a frequency spectrum processing of the lossy compressed data rendered by the first lossy compression, a second lossy compression for a second set of the sub-bands, the second lossy compression compressing a designated magnitude of at least one bin in each sub-band of the second set that is representative of that sub-band and a designated phase of at least one bin in each sub-band of the second set that is representative of that sub-band, wherein the second set includes those sub-bands having indices that are less than the first index and greater than or equal to a second index.

19. An echo cancellation system for processing a plurality of frames of data, the system comprising:

a processor; and a non-transitory, computer readable medium storing instructions that, when executed by the processor, configure the processor to:

partition and store a frequency spectrum of bins of real and imaginary data into a smaller number of sub-bands;

execute a first lossy compression for a first set of the sub-bands, the first lossy compression compressing a designated magnitude of at least one bin in each sub-band of the first set that is representative of that sub-band and a designated phase of at least one bin in each sub-band of the first set that is representative of that sub-band, wherein the first set includes those sub-bands having indices that are greater than or equal to a first index;

execute, subsequent to a frequency spectrum processing of the lossy compressed data rendered by the first lossy compression, a second lossy compression for a second set of the sub-bands, the second lossy compression compressing a designated magnitude of at least one bin in each sub-band of the second set that is representative of that sub-band and a designated phase of at least one bin in each sub-band of the second set that is representative of that sub-band, wherein the second set includes those sub-bands having indices that are less than the first index and greater than or equal to a second index; and perform processing of the plurality of frames of data based on sub-sampling of parameters for select subsets of sub-bands.

20. The echo cancellation system of claim 19, wherein the instructions, when executed by the processor, further configure the processor to determine a first number of sub-bands for a module of the echo cancellation system to process for a first set of the plurality of frames and a second number of sub-bands for the module to process for a second set of the plurality of frames, such that a sub-band count alternates between the first number and the second number during processing of each pair of sequential frames.

21. The echo cancellation system of claim 19, wherein the instructions, when executed by the processor, further configure the processor to, for each sub-band of the first and second sets of sub-bands:

determine a bin within the sub-band having a maximum magnitude; and index the bin within the sub-band having the maximum magnitude.

* * * * *